US005899657A

United States Patent [19]

Hodges

[11] Patent Number: 5,899,657

[45] Date of Patent: May 4, 1999

[54] AUTOMATED MECHANICAL STORAGE FACILITY

[76] Inventor: Clarence Hodges, 271 El Sereno Dr., Scotts Valley, Calif. 95066

[21] Appl. No.: 09/015,111

[22] Filed: Jan. 29, 1998

[51] Int. Cl.[6] ..... E04H 6/08

[52] U.S. Cl. ..... 414/609; 414/233

[58] Field of Search ..... 414/609, 331, 414/278, 233, 234, 237, 238, 251, 240–249

[56] References Cited

U.S. PATENT DOCUMENTS

| | | | |
|---|---|---|---|
| 2,663,446 | 12/1953 | Romain | 414/243 |
| 2,899,086 | 8/1959 | de Saint-Andre | 414/233 X |
| 3,076,539 | 2/1963 | Colson | 414/242 X |
| 3,110,393 | 11/1963 | Hurt | 414/248 X |
| 3,250,804 | 5/1966 | Lemelson | 414/278 X |
| 3,414,141 | 12/1968 | Rougemort | 414/247 X |
| 3,432,044 | 3/1969 | Stienen | 414/237 |
| 3,780,852 | 12/1973 | Weiss et al. | 414/331 X |
| 3,868,027 | 2/1975 | Matsuura | 414/251 |
| 4,067,437 | 1/1978 | Franti | 414/251 X |
| 4,998,857 | 3/1991 | Paravella et al. | 414/331 |
| 5,288,194 | 2/1994 | Ueda et al. | 414/278 X |
| 5,338,143 | 8/1994 | Matsuda et al. | 414/245 X |
| 5,447,407 | 9/1995 | Weaver et al. | 414/331 X |
| 5,593,269 | 1/1997 | Bernard, II | 414/331 |

FOREIGN PATENT DOCUMENTS

| | | | |
|---|---|---|---|
| 1280541 | 10/1968 | Germany | 414/241 |
| 54-113167 | 9/1979 | Japan | 414/251 |
| 60-93007 | 5/1985 | Japan | 414/331 |
| 1-17708 | 1/1989 | Japan | 414/331 |
| 91017937 | 11/1991 | WIPO | 414/331 |

*Primary Examiner*—David A. Bucci

[57] ABSTRACT

An automated mechanical storage facility is provided including at least one closed loop track assembly. Also included is a plurality of storage units for being slidably moved along the track assembly and further adapted to contain cargo. Further included is a belt for discharging the cargo from the storage units and further receiving cargo thereon.

5 Claims, 4 Drawing Sheets

FIG. 5
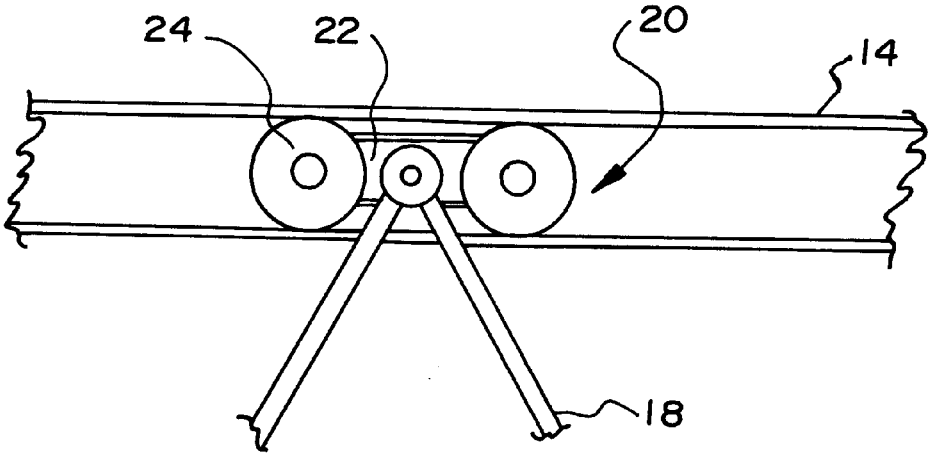
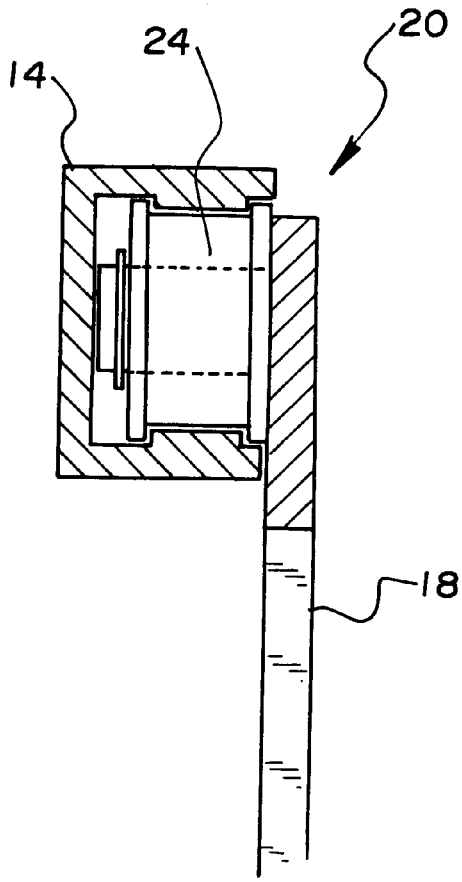
FIG. 6

AUTOMATED MECHANICAL STORAGE FACILITY

BACKGROUND OF THE INVENTION

1. Field of the Invention

The present invention relates to cargo storage facilities and more particularly pertains to a new automated mechanical storage facility for allowing the convenient storage and retrieval of a parked vehicle.

2. Description of the Prior Art

The use of cargo storage facilities is known in the prior art. More specifically, cargo storage facilities heretofore devised and utilized are known to consist basically of familiar, expected and obvious structural configurations, notwithstanding the myriad of designs encompassed by the crowded prior art which have been developed for the fulfillment of countless objectives and requirements.

Known prior art cargo storage facilities include U.S. Pat. No. 5,314,285; U.S. Pat. No. 5,069,592; U.S. Pat. No. 5,066,187; U.S. Pat. No. 5,039,269; U.S. Pat. No. 5,032,053; and U.S. Pat. No. 5,024,571.

In these respects, the automated mechanical storage facility according to the present invention substantially departs from the conventional concepts and designs of the prior art, and in so doing provides an apparatus primarily developed for the purpose of allowing the convenient storage and retrieval of a parked vehicle.

SUMMARY OF THE INVENTION

In view of the foregoing disadvantages inherent in the known types of cargo storage facilities now present in the prior art, the present invention provides a new automated mechanical storage facility construction wherein the same can be utilized for allowing the convenient storage and retrieval of a parked vehicle.

The general purpose of the present invention, which will be described subsequently in greater detail, is to provide a new automated mechanical storage facility apparatus and method which has many of the advantages of the cargo storage facilities mentioned heretofore and many novel features that result in a new automated mechanical storage facility which is not anticipated, rendered obvious, suggested, or even implied by any of the prior art cargo storage facilities, either alone or in any combination thereof.

To attain this, the present invention generally comprises a plurality of oval-shaped track assemblies each spacedly situated in vertical alignment. Each track assembly comprises a pair of parallel track rails each having an outer face, a top face, and a bottom face. As shown in FIG. 6, the rails of the track define an open inner face and an interior space. Also included is a plurality of storage units each having a bottom face with a planar rectangular configuration. A peripheral lip is integrally coupled to a periphery of the bottom face and extends upwardly therefrom. Two pairs of arms are each fixedly coupled to opposite sides of the bottom face of the storage unit and extend upwardly to define a triangular configuration. As shown in FIGS. 5 & 6, a roller assembly is provided including a vertically oriented plate with a pair of rollers rotatably coupled to opposite ends thereof. These rollers are adapted for being situated within the interior space of an associated one of the rails of the corresponding track assembly. The apex of each pair of arms is pivotally coupled to a central extent of the corresponding plate. The storage unit thus is adapted to move along the associated track assembly. An elevator assembly includes a bottom face with a planar rectangular configuration. Similar to the storage unit, a peripheral lip integrally is coupled to a periphery of the bottom face of the elevator assembly and extends upwardly therefrom. Two pairs of arms are each fixedly coupled to opposite sides of the bottom face of the storage unit and extend upwardly to define a triangular configuration. During use, an elevator cable is coupled to an apex of the pairs of arms for allowing the raising and lowering of the elevator assembly level with a selected one of the track assemblies. As shown in FIGS. 3 & 4, each of the storage units and elevation assemblies further include a pair of halves each including a plurality of elongated rollers rotatably coupled between opposite sides. These rollers reside level with an upper peripheral edge of the peripheral lip. As such, the rollers remain in a common horizontal plane. A pair of drive cylinders are mounted on opposite sides of the rollers in parallel therewith. Wrapped about the rollers and drive cylinders is a belt. The drive cylinders are adapted to move the belt such that cargo may be moved on to and removed from the storage units and elevation assemblies.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new automated mechanical storage facility apparatus and method which has many of the advantages of the cargo storage facilities mentioned heretofore and many novel features that result in a new automated mechanical storage facility which is not anticipated, rendered obvious, suggested, or even implied by any of the prior art cargo storage facilities, either alone or in any combination thereof.

It is another object of the present invention to provide a new automated mechanical storage facility which may be easily and efficiently manufactured and marketed.

It is a further object of the present invention to provide a new automated mechanical storage facility which is of a durable and reliable construction.

An even further object of the present invention is to provide a new automated mechanical storage facility which is susceptible of a low cost of manufacture with regard to both materials and labor, and which accordingly is then susceptible of low prices of sale to the consuming public, thereby making such automated mechanical storage facility economically available to the buying public.

Still yet another object of the present invention is to provide a new automated mechanical storage facility which provides in the apparatuses and methods of the prior art some of the advantages thereof, while simultaneously overcoming some of the disadvantages normally associated therewith.

Still another object of the present invention is to provide a new automated mechanical storage facility for allowing the convenient storage and retrieval of a parked vehicle.

Even still another object of the present invention is to provide a new automated mechanical storage facility that includes at least one closed loop track assembly. Also included is a plurality of storage units for being slidably moved along the track assembly and further adapted to contain cargo. Further included is a belt for discharging the cargo from the storage units and further receiving cargo thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a side view of one of the rails of the track assemblies of the present invention.

FIG. 6 is a side view taken along line 6—6 shown in FIG. 3.

DESCRIPTION OF THE PREFERRED EMBODIMENT

Figure 1:
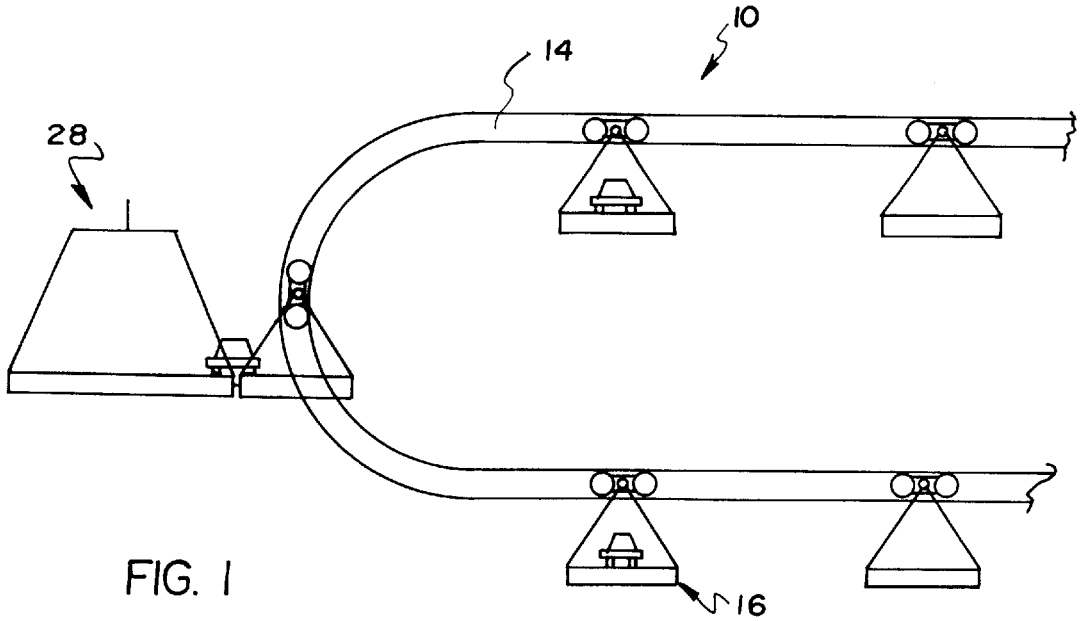
FIG. 1 is a perspective view of a new automated mechanical storage facility according to the present invention.

With reference now to the drawings, and in particular to FIGS. 1 through 8 thereof, a new automated mechanical storage facility embodying the principles and concepts of the present invention and generally designated by the reference numeral 10 will be described.

The present invention, designated as numeral 10, includes a plurality of oval-shaped track assemblies 12 each spacedly situated in vertical alignment. Each track assembly comprises a pair of parallel track rails 14 each having an outer face, a top face, and a bottom face. As shown in FIG. 6, the rails of the track define an open inner face and an interior space. An inner surface of the top face and bottom face has a protrusion integrally formed thereon with a rectangular configuration along an entire length thereof for reasons that will become apparent hereinafter.

Also included is a plurality of storage units 16 each having a bottom face with a planar rectangular configuration. A peripheral lip is integrally coupled to a periphery of the bottom face and extends upwardly therefrom. Two pairs of arms IS are each fixedly coupled to opposite sides of the bottom face of the storage unit and extend upwardly to define a triangular configuration.

As shown in FIGS. 5 & 6, a roller assembly 20 is provided including a vertically oriented plate 22 with a pair of rollers 24 rotatably coupled to opposite ends thereof. These rollers are adapted for being situated within the interior space of an associated one of the rails of the corresponding track assembly. It should be noted that the rollers each have annular flanges for encompassing the protrusion, as shown in FIG. 6. The apex of each pair of arms is pivotally coupled to a central extent of the corresponding plate. The storage unit thus is adapted to move along the associated track assembly. Preferably, a motor is associated with at least one of the rollers of each storage unit which has teeth for engaging teeth formed in the track for allowing the selective control of the movement of the storage units by a user.

Various alternate embodiments of the present invention includes track assemblies with different configurations. Further, the elevator may be replaced with staggered linearly moving transporters 27. Note FIG. 8. This embodiment would be used when the track assemblies reside at a similar elevation.

An elevator assembly 28 includes a bottom face with a planar rectangular configuration. Similar to the storage unit, a peripheral lip integrally is coupled to a periphery of the bottom face of the elevator assembly and extends upwardly therefrom. Two pairs of arms are each fixedly coupled to opposite sides of the bottom face of the storage unit and extend upwardly to define a triangular configuration. During use, an elevator cable is coupled to an apex of the pairs of arms for allowing the raising and lowering of the elevator assembly level with a selected one of the track assemblies.

Figure 3:
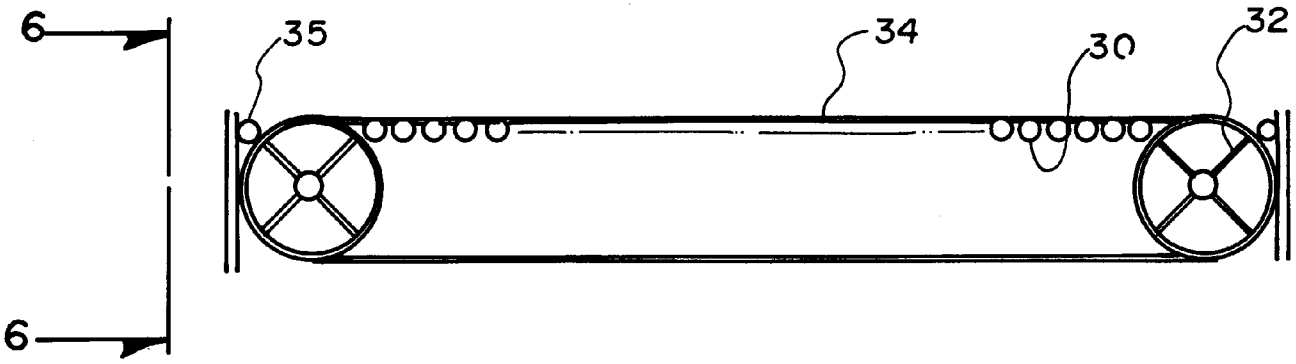
FIG. 3 is a cross-sectional view of the belt and rollers of either one of the storage units or elevator assemblies of the present invention.
Figure 4:
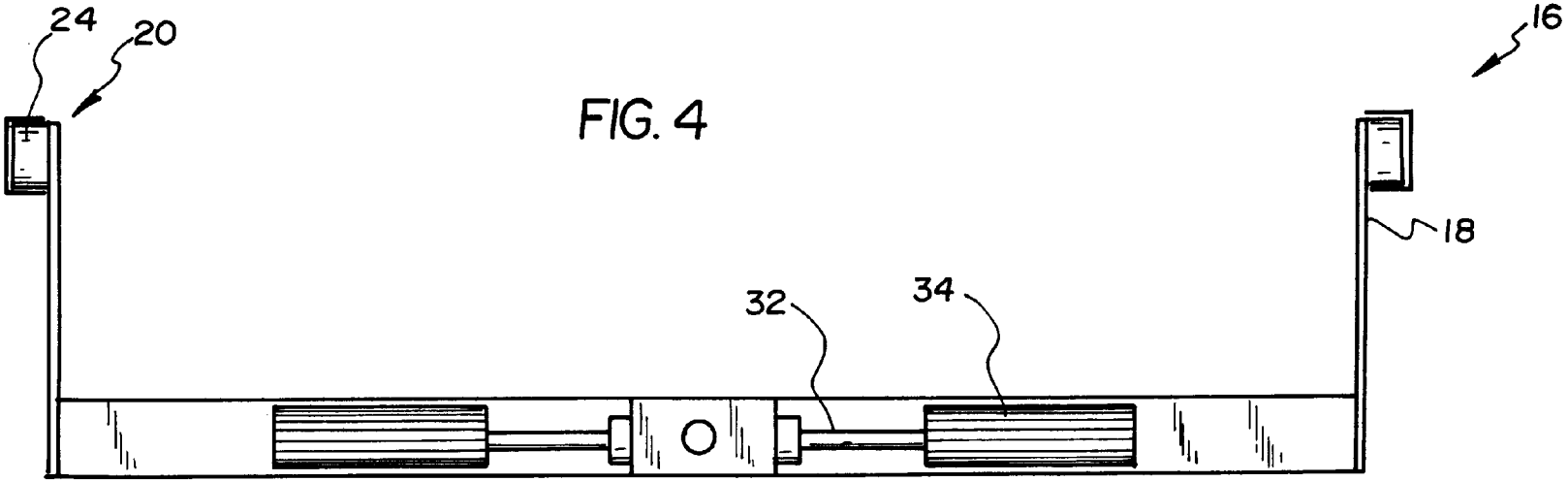
FIG. 4 is another cross-sectional view of the components of FIGS. 5.
Figure 7:
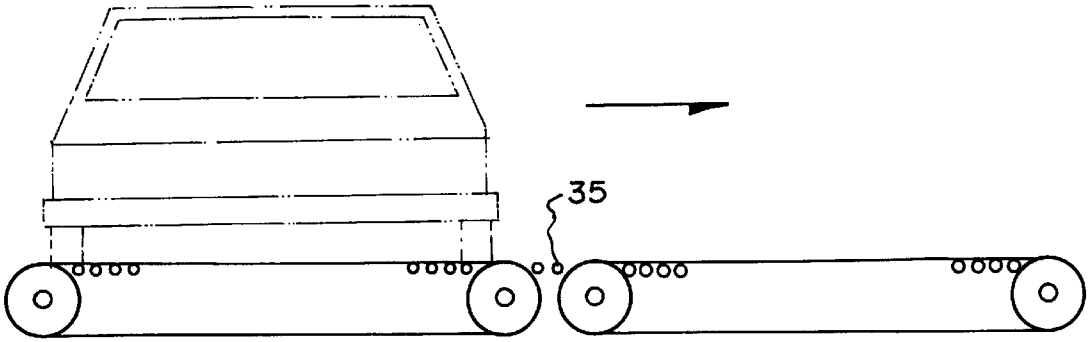
FIG. 7 is a side view of the storage unit and elevator assembly of FIG. 2.
Figure 8:
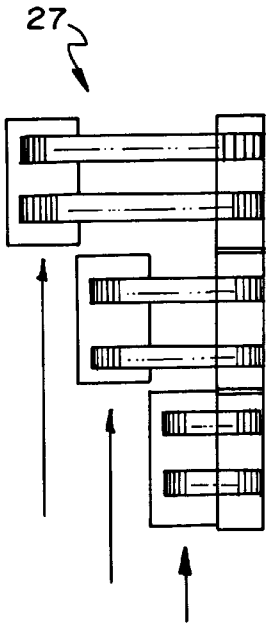
FIG. 8 is an illustration of an alternate embodiment of the present invention.

As shown in FIGS. 3 & 4, each of the storage units and elevation assemblies further include a pair of halves each having a plurality of elongated rollers 30 rotatably coupled between opposite sides of the unit or assembly. These rollers reside level with an upper peripheral edge of the peripheral lip and are preferably only slightly spaced. During use, the rollers remain in a common horizontal plane. A pair of drive cylinders 32 are mounted on opposite sides of the rollers in parallel therewith. Wrapped about the rollers and drive cylinders is a belt 34.

Figure 2:
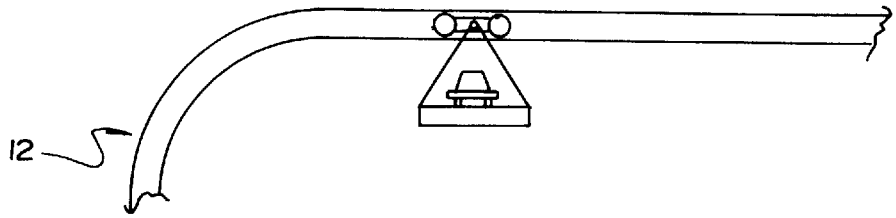
FIG. 2 is a top view of one of the storage units and elevator assemblies of the present invention in abutment.
Figure 2:
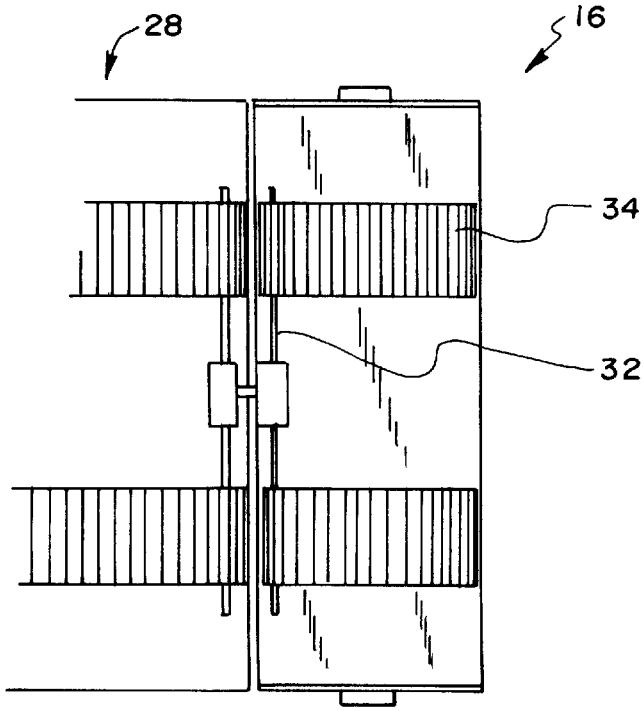

In use, the drive cylinders are adapted to move the belt such that cargo may be moved on to and removed from the storage units and elevation assemblies. To accomplish this, at least one of the drive cylinders of each half arc each connected to a common motor is selectively controlled by a user. In the preferred embodiment, auxiliary rollers 35 are mounted between the peripheral lip and the drive rollers for facilitating the removal of the cargo. As best shown in FIG. 2, a pair of belt and roller assemblies are included for specifically accommodating automobiles or the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automated mechanical storage facility comprising, in combination:

a plurality of oval-shaped track assemblies each spacedly situated in vertical alignment, each track assembly comprising a pair of parallel track rails each having an outer face, a top face, and a bottom face thereby defining an open inner face and an interior space;

a plurality of storage units each including a bottom face with a planar rectangular configuration and a peripheral lip integrally coupled to a periphery of the bottom face and extending upwardly therefrom, two pairs of arms are each fixedly coupled to opposite sides of the bottom face of the storage unit and extending upwardly, and a roller assembly including a vertically oriented plate with a pair of rollers rotatably coupled to opposite ends thereof for being situated within the interior space of an associated one of the rails of the corresponding track assembly, wherein an apex of each pair of arms is pivotally coupled to a central extent of the corresponding plate, whereby the storage unit is adapted to move along the associated track assembly;

an elevator assembly including a bottom face with a planar rectangular configuration and a peripheral lip integrally coupled to a periphery of the bottom face and extending upwardly therefrom, two pairs of arms each fixedly coupled to opposite sides of the bottom face of the storage unit and extending upwardly, wherein a elevator cable is coupled to an apex of the pairs of arms for allowing the raising and lowering of the elevator assembly level with a selected one of the track assemblies;

said storage units and elevator assembly each further including a pair of halves each including a plurality of elongated rollers rotatably coupled between opposite sides level with an upper peripheral edge of the peripheral lip such that the rollers remain in a common horizontal plane, a pair of drive cylinders mounted on opposite sides of the rollers in parallel therewith, a belt wrapped about the rollers and drive cylinders, wherein the drive cylinders are adapted to move the belt such that cargo may be moved onto and removed from the storage units and elevator assembly.

2. An automated mechanical storage facility comprising, in combination:

a plurality of track assemblies each spacedly situated in vertical alignment, each track assembly comprising at least one track rail;

a plurality of storage units each including a bottom face and a peripheral lip integrally coupled to a periphery of the bottom face and extending upwardly therefrom, at least one arm coupled to the storage unit and extending upwardly, and a roller assembly connected to the at least one arm for sliding along one of the track assemblies; and an elevator assembly including a bottom face and a peripheral lip integrally coupled to a periphery of the bottom face and extending upwardly therefrom, at least one arm coupled to the elevator and extending upwardly, wherein an elevator cable is coupled to the at least one arm for allowing the raising and lowering of the elevator assembly level with a selected one of the track assemblies;

said storage units and elevation assembly each further including a pair of halves each including a plurality of elongated rollers which rollers remain in a common horizontal plane, a pair of drive cylinders mounted on opposite sides of the rollers in parallel therewith, and a belt wrapped about the rollers and drive cylinders, wherein the drive cylinders are adapted to move the belt such that cargo may be moved on to and removed from the storage units and elevation assembly.

3. An automated mechanical storage facility as set forth in claim 2 wherein the track assemblies are each substantially oval-shaped.

4. An automated mechanical storage facility as set forth in claim 2 and further including auxiliary rollers mounted between the peripheral lip and the drive cylinders for facilitating transfer of cargo between the elevation assembly and the storage units.

5. An automated mechanical storage facility as set forth in claim 2 wherein the track assemblies each includes a pair of track rails which each movably receive roller assemblies coupled to two arms coupled to and extending upwardly from the storage units.

* * * * *